US007520786B2

(12) United States Patent
Triantopoulos et al.

(10) Patent No.: US 7,520,786 B2
(45) Date of Patent: Apr. 21, 2009

(54) TRANSFORMER STUD CONNECTOR

(75) Inventors: George Triantopoulos, Collierville, TN (US); Ken Banas, Germantown, TN (US)

(73) Assignee: Thomas & Betts International, Inc., Sparks, NV (US)

( * ) Notice: Subject to any disclaimer, the term of this patent is extended or adjusted under 35 U.S.C. 154(b) by 1532 days.

(21) Appl. No.: 10/047,471

(22) Filed: Jan. 14, 2002

(65) Prior Publication Data

US 2002/0094729 A1 Jul. 18, 2002

Related U.S. Application Data

(60) Provisional application No. 60/262,430, filed on Jan. 17, 2001.

(51) Int. Cl.
*H01R 11/09* (2006.01)

(52) U.S. Cl. ..... 439/798

(58) Field of Classification Search ..... 439/798, 439/724, 797, 796; 174/138 F
See application file for complete search history.

(56) References Cited

U.S. PATENT DOCUMENTS 4,214,806 A * 7/1980 Kraft ..... 174/72 R
4,382,651 A * 5/1983 Klosin et al. ..... 439/359
4,547,627 A * 10/1985 McGrane ..... 174/138 F
D302,420 S 7/1989 McGrane
D309,664 S 7/1990 McGrane
D320,381 S * 10/1991 McGrane ..... D13/147
D346,150 S 4/1994 Triantopoulos
D377,782 S 2/1997 Fillinger
5,690,516 A 11/1997 Fillinger
5,848,913 A 12/1998 Ashcraft
5,931,708 A 8/1999 Annas et al.
6,579,131 B1 6/2003 Ashcraft et al.

* cited by examiner

*Primary Examiner*—Chandrika Prasad
(74) *Attorney, Agent, or Firm*—Hoffmann & Baron, LLP

(57) ABSTRACT

A connector is attachable to an extending transformer stud. The connector includes an elongate central body having a longitudinal bore opening at one end for insertable accommodation of the transformer stud. An elongate conductor accommodating body extends along the central body in side-by-side relationship thereto. The conductor accommodating body includes a plurality of spaced apart conductor insertion apertures. The apertures are spaced along the length of the conductor accommodating body so as to be longitudinally coextensive with the longitudinal bore of the central body.

9 Claims, 1 Drawing Sheet

TRANSFORMER STUD CONNECTOR

CROSS-REFERENCE TO RELATED APPLICATION

This application claims priority to the provisional application serial number 60/262,430, filed on Jan. 17, 2001.

FIELD OF THE INVENTION

The present invention relates generally to a connector for connecting multiple connectors to a transformer. More particularly, the present invention relates to a transformer stud connector which permits the connection of plural connectors to a stud extending from a transformer.

BACKGROUND OF THE INVENTION

Electrical transformers are typically used to distribute electrical power from main utility lines for secondary distribution. The transformer accepts the main utility line on the primary side of the transformer and distributes the power from a secondary side of the transformer. An electrical step-down is provided by the transformer so as to provide for the proper secondary distribution of electrical power for residential and commercial use.

The transformer is normally housed in a steel cabinet. A threaded copper stud extends from the secondary side of the transformer from which secondary distribution is provided. Plural electrical conductors, connected to the threaded stud, provide for distribution of power to the end user.

In order to connect the conductor to the stud, a transformer stud connector is employed. These transformer stud connectors are elongate, electrically conductive members which are inserted over the copper stud extending from the secondary side of the transformer. The stud connector may be threadingly attached to the transformer stud. Extending longitudinally therefrom are a plurality of conductor accommodating ports wherein the ends of conductors may be inserted. Each conductor port has an associated set screw to effect mechanical and electrical connection to the transformer stud connector. Examples of transformer stud connectors are shown in U.S. Pat. Nos. 5,931,708; 5,848,913; 5,690,516; DES Pat No. 377,782; DES Pat. No. 346,150; and DES Pat. No. 309,664.

In a typical arrangement, an elongate transformer stud connector is attached at one of its longitudinal ends to the transformer stud. The conductor ports extend in longitudinally successive fashion therefrom. Thus, as may be appreciated, the transformer stud connector must have an extended length sufficient to be positioned over the extending longitudinal transformer stud, and further, to accommodate multiple conductors in longitudinally spaced succession. Thus, conventional transformer stud connectors are excessively long. This construction of the transformer stud connector, therefore, results in the secondary side of the transformer cabinet having to have sufficient space and longitudinal clearance to accommodate the connector.

It is desirable to provide a transformer stud connector which will accommodate multiple cables without extending the overall length of the connector.

SUMMARY OF THE INVENTION

The present invention provides a connector which allows attachment to an extending transformer stud wherein the conductor into the connector and generally occupies only the longitudinal extent of the extending transformer stud.

The present invention therefore provides a connector for attachment to an extending transformer stud. The connector includes an elongate central body having a longitudinal bore, opening at one end for insertable accommodation of the transformer stud. An elongate conductor accommodating body extends along the central body in side-by-side relationship therewith. The conductor accommodating body includes a plurality of spaced apart conductor insertion apertures. The apertures are spaced along the length of the conductor accommodating body so as to be longitudinally coextensive with the longitudinal bore of the central body.

A plurality of set screw receiving apertures are also provided in the conductor accommodating body for accommodating set screws to secure the conductors in the conductor receiving apertures.

As shown by way of a preferred embodiment herein, the connector of the present invention further includes an additional elongate conductor accommodating body extending along the central body in side-by-side relationship thereto. The additional body includes a plurality of additional conductor receiving apertures spaced along the length of the additional body so as to be longitudinally coextensive with the longitudinal bore in the central body.

In addition, the conductor receiving body and the additional conductor receiving body may be supported on opposite sides of the central body. Furthermore, the conductor receiving body, the central body, and the additional conductor receiving body may be arranged in stepwise succession.

DETAILED DESCRIPTION OF THE PREFERRED EMBODIMENT

Figure 1:
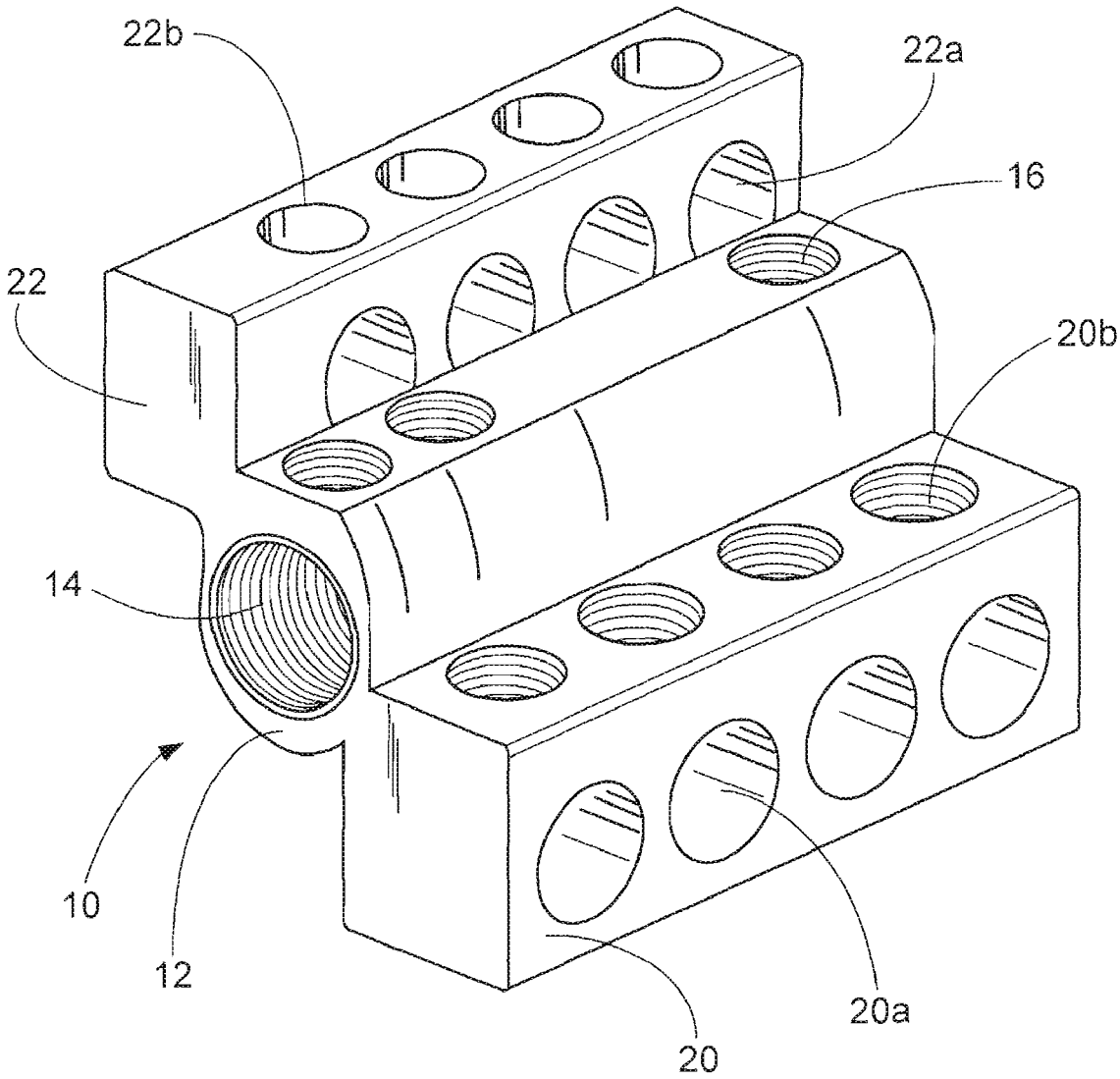
FIG. 1 is a perspective showing of the transformer stud connector of the present invention.

Referring to FIG. 1, an improved transformer stud connector of the present invention is shown.

The transformer stud connector 10 is an integrally formed metallic member, preferably formed of aluminum or other material, having high electrical conductivity. Transformer stud connector 10 includes central, generally elongate cylindrical body 12, having a central bore 14 therethrough. The central bore 14 may be internally threaded so as to accommodate the extending, externally threaded transformer stud (not shown). The length of body 12 need only be approximately the length of the extending portion of the stud so that when the body is placed over the stud, the stud and the body extend generally the same distance. In certain situations it is possible for slip-accommodation of body 12 over an unthreaded stud. In these cases, an upper surface of the body may include a plurality of internally threaded openings 16 in communication with central bore 14 which accommodate set screws (not shown) or other securement devices so as to secure the body to the transformer stud and establish mechanical and electrical connection therewith.

Transformer stud connector 10 further includes first and second conductor accommodating portions 20 and 22. Each portion 20 and 22 is an elongate, generally solid rectangular member extending the length of cylindrical body 12. Portions 20 and 22 extend in step-wise fashion above and below body 12 in side-by-side relationship. Portion 22 extends upwardly from one side of cylindrical body 12, while portion 22 extends downwardly from the opposite side of cylindrical body 12. Each portion 20 and 22 includes a plurality of longitudinally spaced aligned conductor receiving ports 20*a* and 22*a* respectively. Each of the ports extend from one side surface of portions 20 and 22. As shown in FIG. 1, conductor ports 20*a* and 22*a* are positioned on similarly facing surfaces so that conductors inserted into ports 20*a* can be inserted from the same direction as conductors inserted into ports 22*a*. Portions 20 and 22 further include a plurality of set screw accommodating apertures 20*b* and 22*b* respectively. Each set screw aperture is in communication with the respective conductor receiving port so that set screws (not shown) may be inserted therein to mechanically and electrically secure the ends of the conductors within the stud connector 10.

As may be appreciated, the construction and arrangement of the transformer stud connector 10 allows the connector to be placed over a threaded transformer stud. A plurality of conductors may extend therefrom in an arrangement which generally occupies only the longitudinal extent of the extending transformer stud. This is provided by the arrangement of the portions 20 and 22 which lie longitudinally coextensive with the central body 12 which is attached to the stud. The transformer stud connector 10 of the present invention occupies to a less longitudinal extent than stud connectors of the prior art. Therefore, transformer stud connector 10 may be used in situations where cabinet space is a premium.

In a further embodiment, one end of body 12 may include a central bore 14 of a first diameter to accommodate a particular site of transformer stud. The opposite end of body 12 may include a central bore of differing size to accept a different size transformer stud. Each of these bores can be either threaded or unthreaded or a combination thereof to accommodate the appropriate transformer stud.

It will be appreciated that the present invention has been described herein with reference to certain preferred or exemplary embodiments. The preferred or exemplary embodiments described herein may be modified, changed, added to or deviated from without departing from the intent, spirit and scope of the present invention, and it is intended that all such additions, modifications, amendment and/or deviations be included within the scope of the following claims.

What is claimed is:

1. A connector for attachment to an extending transformer stud comprising:

an elongate central body having a longitudinal bore, opening at one end for insertable accommodation of said transformer stud;

an elongate conductor accommodating body extending along said central body in step-wise fashion above and below said central body in side-by-side relationship, said conductor accommodating body including a plurality of spaced apart conductor insertion apertures, said apertures being spaced along the length of said conductor accommodating body so as to be longitudinally coextensive with said longitudinal bore of said central body.

2. A connector at claim 1 wherein said central body includes at least one said screw receiving aperture in communication with said longitudinal bore.

3. A connector of claim 1 wherein said conductor accommodating body includes a plurality of said screw receiving aperture in communication with said conductor insertion apertures.

4. A connector of claim 3 further including an additional elongate conductor accommodating body extending along said central body in side-by-side relationship thereto.

5. A connector of claim 4 wherein said additional body includes a plurality of spaced apart additional conductor receiving apertures, said additional apertures being spaced along the length of said additional body so as to be longitudinally coextensive with said longitudinal bore of said central body.

6. A connector of claim 5 wherein said additional conductor accommodating body includes a plurality of additional set screw receiving apertures in communication with said additional conductor insertion apertures.

7. A connector of claim 6 wherein said conductor receiving apertures of said conductor accommodating body and said additional conductor receiving apertures of said additional conductor accommodating body having conductor insertion openings facing in the same direction.

8. A connector of claim 7 wherein said conductor receiving body and said additional conductor receiving body are on opposite sides of said central body.

9. A connector of claim 8 wherein said conductor receiving body, said central body of said additional conductor receiving body are arranged in stepwise succession.

* * * * *